US007785008B2

(12) United States Patent
Schoenig et al.

(10) Patent No.: US 7,785,008 B2
(45) **Date of Patent: *Aug. 31, 2010**

(54) PLANAR LOADED OPERABLY CONFORMABLE MATERIAL CONTAINMENT SYSTEM

(75) Inventors: Darrell Arthur Schoenig, Bellvue, CO (US); Jay Dean Dokter, Loveland, CO (US)

(73) Assignee: PortaQuip LLC, Loveland, CO (US)

( * ) Notice: Subject to any disclaimer, the term of this patent is extended or adjusted under 35 U.S.C. 154(b) by 643 days.

This patent is subject to a terminal disclaimer.

(21) Appl. No.: 11/191,635

(22) Filed: Jul. 27, 2005

(65) Prior Publication Data

US 2007/0025646 A1 Feb. 1, 2007

(51) Int. Cl.

| | |
|---|---|
| ***B65D 30/00*** | (2006.01) |
| ***B65D 33/06*** | (2006.01) |
| ***B65D 33/00*** | (2006.01) |
| ***A47F 13/06*** | (2006.01) |

(52) U.S. Cl. ..... 383/4; 383/16; 383/97; 294/1.1

(58) Field of Classification Search ..... 383/4, 383/16, 97; 190/903; 294/1.1
See application file for complete search history.

(56) References Cited

U.S. PATENT DOCUMENTS

| | | | | |
|---|---|---|---|---|
| 1,385,695 | A * | 7/1921 | MacCormack et al. | 383/92 |
| 2,254,578 | A | 9/1941 | O'Brien | |
| 2,324,495 | A * | 7/1943 | Deming | 220/592.2 |
| 2,442,105 | A * | 5/1948 | Vacheron | 2/69.5 |
| 2,479,203 | A | 8/1949 | Brown | |
| 2,690,778 | A | 10/1954 | Walsh | |
| 2,766,797 | A | 10/1956 | Cowen | |
| 2,804,897 | A | 9/1957 | Wunderwald et al. | |
| 2,974,971 | A | 3/1961 | Buck | |
| 3,024,824 | A | 3/1962 | Bass | |
| 3,073,367 | A * | 1/1963 | Samara | 383/97 |
| 3,312,263 | A | 4/1967 | Wahlstorm | |
| 3,355,187 | A | 11/1967 | Brindle | |
| 3,862,876 | A * | 1/1975 | Graves | 428/83 |
| 4,173,351 | A | 11/1979 | Hetland | |
| 4,337,812 | A | 7/1982 | Trinkner | |
| 4,471,600 | A | 9/1984 | Dunleavy | |
| 4,519,183 | A * | 5/1985 | Parody | 53/461 |
| 4,602,664 | A | 7/1986 | Hullen | |
| 4,604,765 | A | 8/1986 | Schultz | |
| 4,620,396 | A | 11/1986 | Bjorntwedt | |
| 4,634,618 | A * | 1/1987 | Greer et al. | 428/81 |
| 4,984,906 | A * | 1/1991 | Little | 383/4 |
| 5,048,975 | A | 9/1991 | Holbrook | |
| 5,104,133 | A | 4/1992 | Reiner | |
| 5,147,102 | A | 9/1992 | Dyer, Jr. | |
| 5,179,741 | A * | 1/1993 | Book | 5/417 |

(Continued)

OTHER PUBLICATIONS

Bombdesign Creora Style Award, ispo BrandNew Magazine, winter 2007, p. 24-25.

*Primary Examiner*—Jes F Pascua
(74) *Attorney, Agent, or Firm*—Craig R. Miles; CR Miles, P.C.

(57) ABSTRACT

A BigFoot™ Bag material containment system which provides a material container (2) having a flexible layer (26) which can be established in a substantially planar configuration (3) on a support surface (4) for loading material (5) and which operably conforms by closure (15) to provide an enclosed space (20) to contain the loaded material (5).

22 Claims, 13 Drawing Sheets

U.S. PATENT DOCUMENTS 5,211,434 A 5/1993 Lanava
5,251,945 A 10/1993 Stoops
5,297,870 A 3/1994 Weldon
5,364,188 A 11/1994 Godfried et al.
5,480,229 A 1/1996 Thangsrirojkul
5,529,321 A 6/1996 Thompson
5,560,665 A 10/1996 Kelley
5,588,749 A * 12/1996 Ishikawa ..... 383/4
5,660,402 A 8/1997 Jones et al.
5,709,477 A 1/1998 Schinasi et al.
5,943,831 A 8/1999 Pangburn
5,971,611 A 10/1999 Rosengren
6,032,308 A * 3/2000 Chuang ..... 5/502
6,105,842 A 8/2000 Cesare
6,250,470 B1 6/2001 Mackenzie
6,267,504 B1 7/2001 Screen
6,547,110 B2 * 4/2003 O'Hare ..... 224/155
6,565,101 B2 5/2003 Jones, Jr. et al.
6,704,953 B2 3/2004 Fishman
2002/0084197 A1 * 7/2002 Carbonneau ..... 206/216
2003/0190096 A1 * 10/2003 Miodragovic et al. ..... 383/4
2008/0050050 A1 * 2/2008 Seecof ..... 383/4
2010/0008601 A1 * 1/2010 Prudencio ..... 383/4

* cited by examiner

PLANAR LOADED OPERABLY CONFORMABLE MATERIAL CONTAINMENT SYSTEM

I. BACKGROUND

A BigFoot™ Bag material containment system which provides a flexible layer established in a substantially planar configuration on a support surface for loading material which conforms by operation of a closure to provide an enclosed space to contain the loaded material.

Whether a material comprises valuable cargo being transported following the classic Mt. Everest expedition trail or comprises waste material being transported from the backyard to the local dump, containing and transporting the material poses a variety of problems familiar to the ordinary person.

One familiar problem related to containing and transporting material can be the difficulty of containing material amassed or accumulated on conventional tarpaulins or similar flexible sheets ("conventional tarpaulins"). Because conventional tarpaulins can be laid flat for efficient loading of material(s), a numerous and wide variety of devices and methods have been developed to gather or secure opposed portions of the tarpaulin periphery in an attempt to contain the material loaded. For example, cords, straps, or similar elements threaded through holes or grommets in the periphery or corners of the tarpaulin have been used to gather portions of the periphery of a tarpaulin as described for example by U.S. Pat. Nos. 2,766,799, 3,024,824, and 5,943,831; alternately cords attached to the periphery or the corners of the tarpaulin can be tied together to gather portions of the periphery as described for example by U.S. patent application Ser. Nos. 3,355,187, 4,519,183 and 6,267,504; and opposed parts of self-securing adhesive strips or hook and loop fabric fixed to the periphery of the tarpaulin can be joined as described for example by U.S. Pat. Nos. 4,620,396 and 5,364,188 to gather portions of the tarpaulin periphery.

Similarly, numerous and varied devices and methods have been developed for moving conventional tarpaulins on which material has been amassed or accumulated which do not address closure of the periphery of the tarpaulin prior to movement as described for example by U.S. Pat. Nos. 5,147,102; 5,529,321; 5,660,402; 6,565,101; 5,104,133; and 4,173,351.

As to each of these varied devices and methods of containing or transporting material on an open or within a gathered conventional tarpaulin, there is a common problem in that no attempt to close the tarpaulin has been made or only a portion of periphery of the tarpaulin has been drawn upon or joined to contain the material loaded. As such, a substantial portion of the periphery of the tarpaulin may remain open allowing material to egress from the tarpaulin or conversely may remain open allowing ingress of other material into the tarpaulin. In any event, none of these devices or methods of containing material on or within a tarpaulin address the need of closing substantially the entirety of the periphery of the tarpaulin to decrease the transfer of material(s).

Another familiar problem with the use of conventional tarpaulins or other conventional devices which initially lay flat for loading and then alter configuration by coupling or joining portions of the periphery can be that a plurality of discrete closures must be operated to generate the closed condition of the device. This approach is utilized for example by the devices described by U.S. Pat. Nos. 2,254,578 and 3,073,367 each of which utilize four discrete zippers to generate the particular closed configuration. As such, these types of devices may be overly complex or incompatible with containing and transporting cargo or waste materials, or may not operate or may not be practical to operate to generate the closed configuration on the scale necessary to contain the amount of material generally amassed on the conventional tarpaulin.

Moreover, these and other conventional types of devices which have many discrete closures or even a single closure such as a zipper can be prone the egress and ingress of materials through the closure elements such as fine particulates and liquid. As can be understood by U.S. Pat. Nos. 2,254,578 and 3,073,367, as examples, neither conventional device affords any protection against the transfer of material through the plurality of discrete zippers.

Another familiar problem with the use of conventional tarpaulins or other conventional devices which initially lay flat for loading can be that the closure operates to join portions of the periphery of a device to establish a substantially vertical container wall relative to the support surface. For example, U.S. Pat. No. 4,604,765 describes a conventional device which joins adjacent portions of the periphery of a square material by substantially vertical operation of the closure relative to the support surface.

In the case of a conventional tarpaulin where a substantial amount of material can be amassed or accumulated the person may have to bend over to operate the closure, a closure that operates vertically for more than a few inches relative to the support surface may require the person to move the entire body from the bent over position to the upright position to generate the closed condition of the container. Additionally, when a person is in the bent position the forces applied to the closure element may not be directed vertically, but rather the predominant direction of the force applied to the closure may be between the plane of the support surface and the vertical plane of the closure. As such, more overall force may have to be applied to the closure to generate the closed condition of the material container.

Another problem with conventional tarpaulins or other conventional devices which initially lay flat for loading can be a lack of means to substantially fix the location of the tarpaulin during closure operation. Again referring to U.S. Pat. No. 4,604,765, the force of operating the closure in the vertical direction may lift the device from the support surface. Again, in those instances in which the person may be using one hand to hold the portions of the periphery to be joined and one hand to operate the closure, movement of the material container can occur because there is not way to restrain it.

Overall conventional tarpaulins do not appear to disclose a device which lays flat in the open condition for amassing or accumulating materials thereon and provides an open configuration operably coordinated with the range of motion of a person bent over to commence operation of the closure. This lack of a posture coordinated planar configuration may be apparent with respect to the operating angle of the closure relative to angle of a person's body bent to commence operation of the closure, and also with respect to the location of grips and restraints relative to the location of the persons feet or hands in the bent over position, or both.

The instant material containment invention addresses each of these problems related to conventional tarpaulins and containment devices.

II. SUMMARY OF THE INVENTION

Accordingly, a broad object of the invention can be to provide a material container which provides a flexible layer which can be established in a substantially planar configuration on a support surface for loading material and which operably conforms by closure to provide an enclosed space to contain the loaded material.

This broad object of the invention can include particular embodiments of the material container invention which operably conform through the use of a single closure element to provide the enclosed space defined by joining substantially the entirety of the periphery of the flexible layer established in the substantially planar configuration in the open condition.

Another broad object of the invention can be to provide a material container which provides a flexible layer which can be established in a posture coordinated planar configuration on a support surface which operably conforms by closure to provide an enclosed space to contain the loaded material.

This broad object of the invention can include particular embodiments of the material container invention which include a flexible layer having a square or rectangular body coupled on at least one of the opposed sides by a triangular end portion the vertices of which can be held in a first hand adjacent to one another to position a closure element to commence operation at the apex of the triangular end portion located proximate to the support surface. Another benefit of the triangular end portion can be to locate the closure element at an angle from the support surface between about ten degrees and about 45 degrees to accept a greater portion of the directional forces applied by a person operating the closure in the bent position with a second hand. Additionally, the apex of the triangular end portion can provide the further benefit of locating a restraint element for engagement by the foot of the person to fix the location of the closure element during operation. By configuring the substantially planar configuration of the flexible layer of the material container invention to operate in coordinated fashion with the anatomical range of the person's hands and feet, generation of the closed condition of the material container invention can be achieved with greater efficiency and less effort.

Another broad object of the invention can be to provide a closure cover which operates in a first condition to protect the closure element in the closed condition from the ingress of solids or liquids and in a second condition provides sensorially perceivable indicia that the closure cover requires adjustment to protect the closure from ingress of solids or liquids.

Naturally, further objects of the invention are disclosed throughout other areas of the specification, drawings, and claims.

III. A BRIEF DESCRIPTION OF THE DRAWINGS

Figure 12:
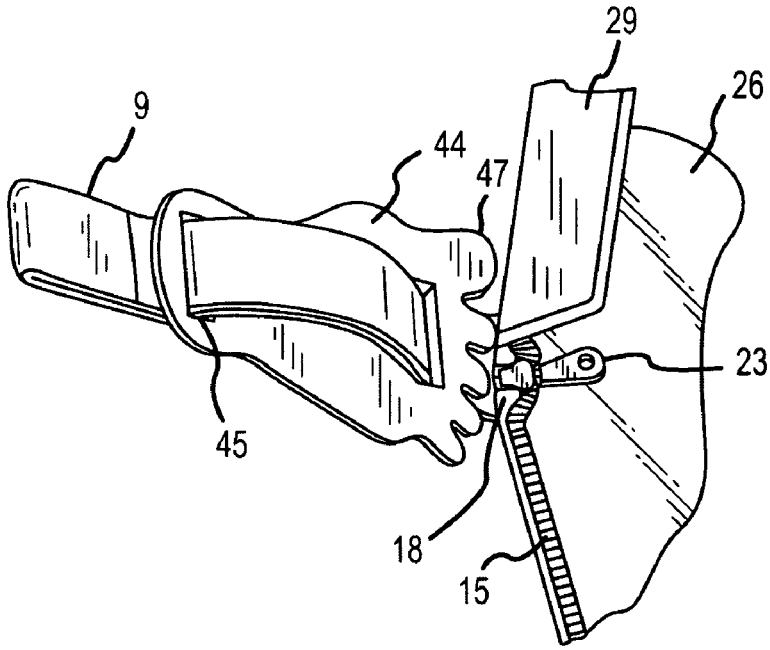

FIG. 12 a perspective view of an embodiment of the force dissemination element releasably coupled to a restraint element.

Figure 13:
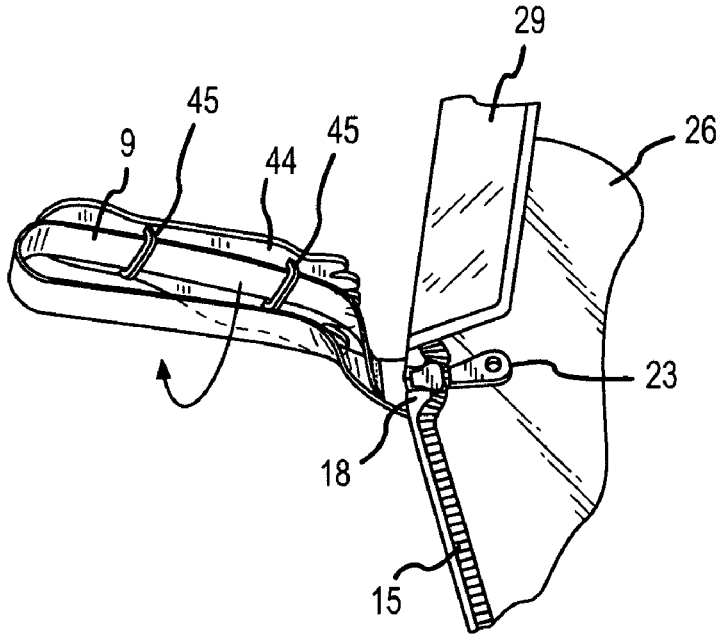

FIG. 13 is a perspective view of an alternate embodiment of the force dissemination element coupled to a restraint element.

Figure 14:
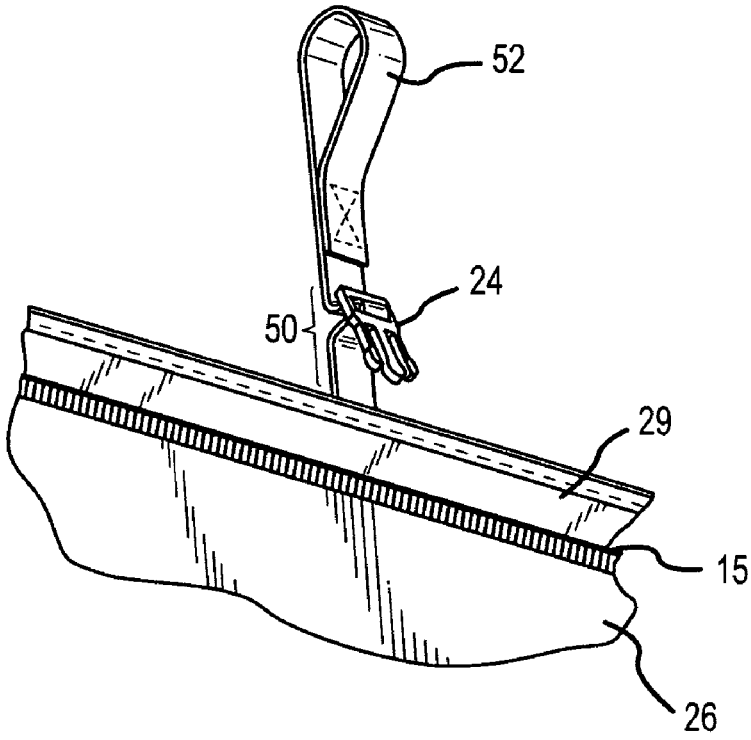

FIG. 14 is a front side perspective view of an embodiment of a constraint element showing a first part of a self interlocking fastener.

Figure 15:
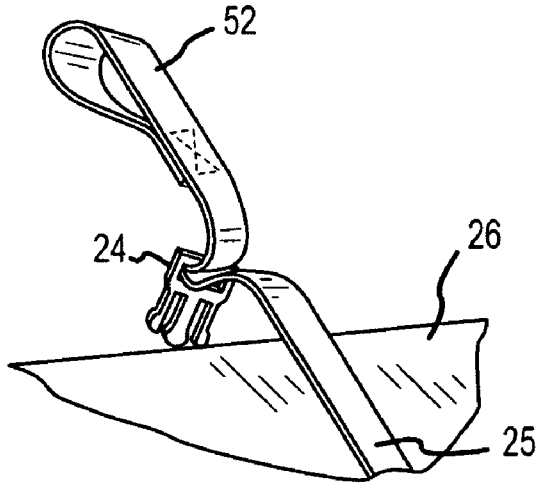

FIG. 15 is a backside perspective view of an embodiment of a constraint element showing a second part of the self interlocking fastener.

Figure 16:
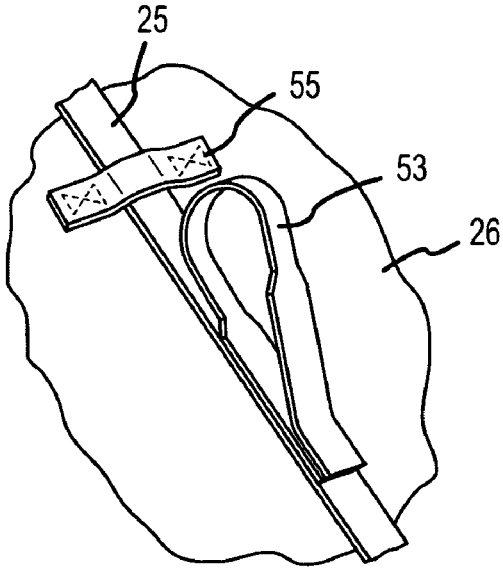

FIG. 16 is a front side perspective view of grip elements coupled to the constraint element shown by FIG. 15.

Figure 17:
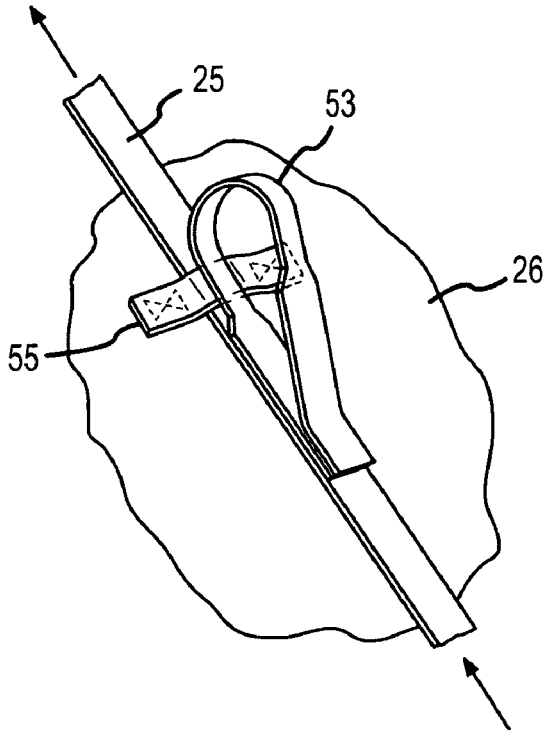

FIG. 17 is a front side perspective view of the constraint element shown by FIG. 15 showing slidable engagement with a portion of the outside surface of a flexible layer of the material container invention.

Figure 18:
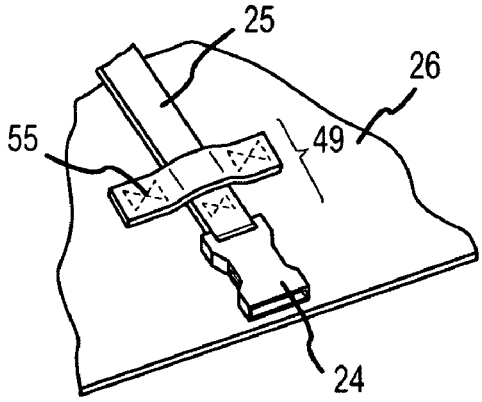

FIG. 18 is front side perspective view of the second part of the self-interlocking fastener shown by FIG. 14.

Figure 19:
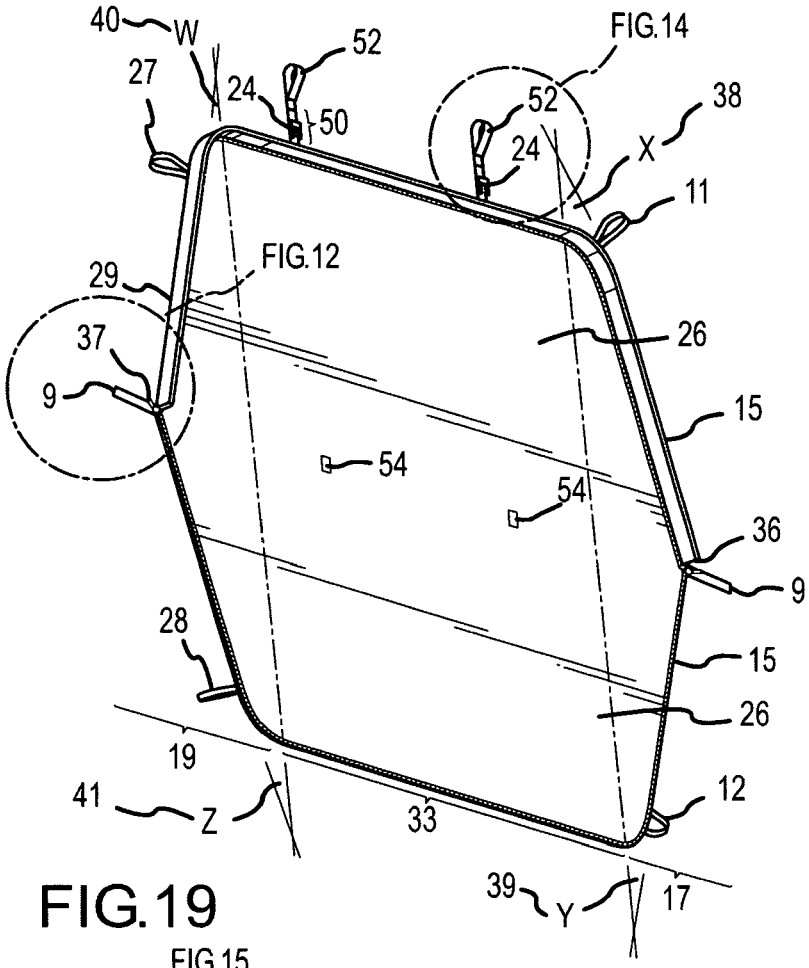

FIG. 19 is a inside perspective view of an alternate embodiment of the material container invention.

Figure 20:
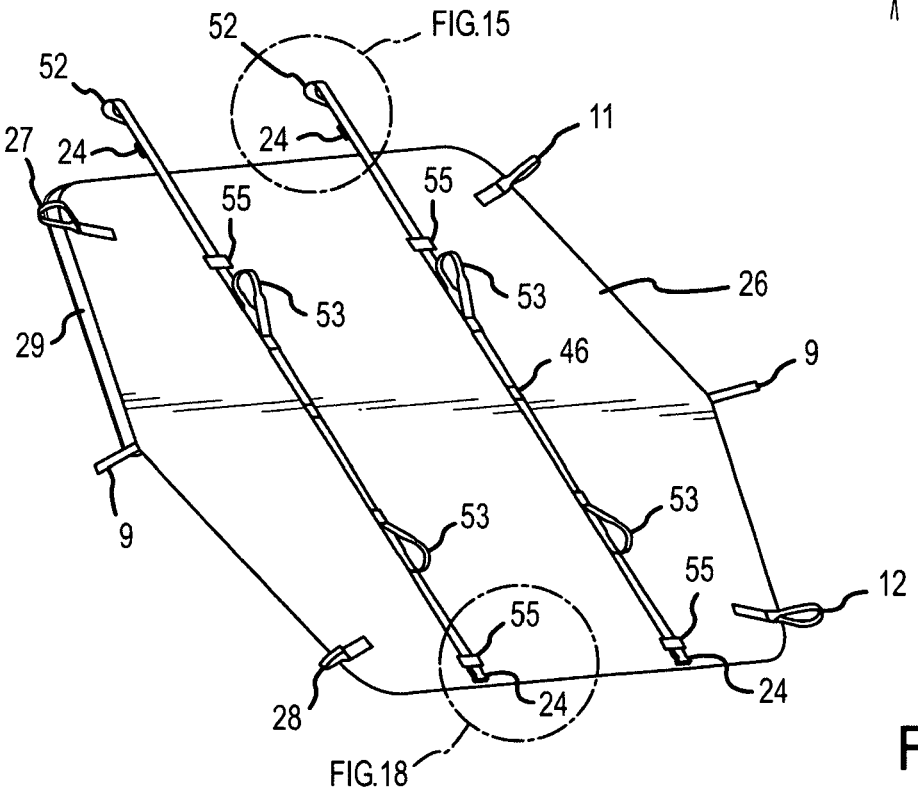

FIG. 20 is an outside perspective view of the alternate embodiment of the material container invention shown by FIG. 19.

Figure 21:
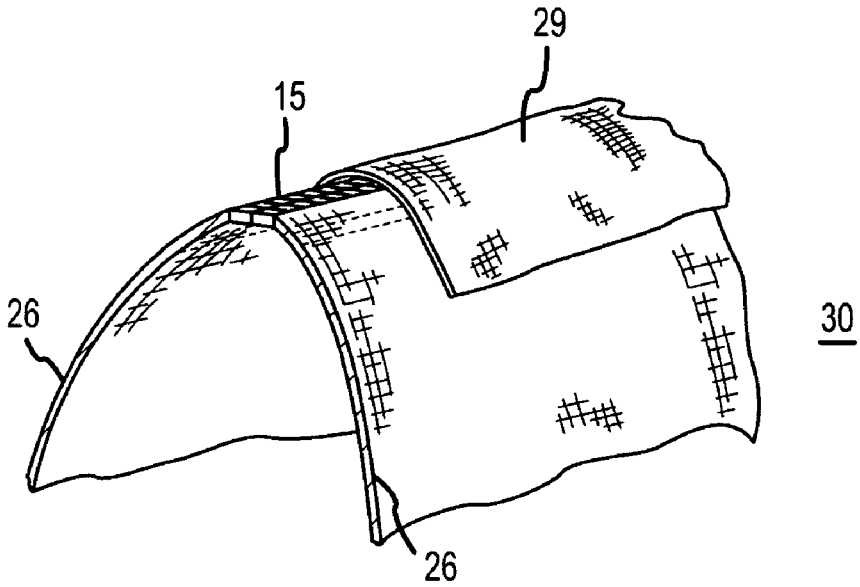

FIG. 21 is a perspective view of a portion of a closure cover in the closure cover position.

Figure 22:
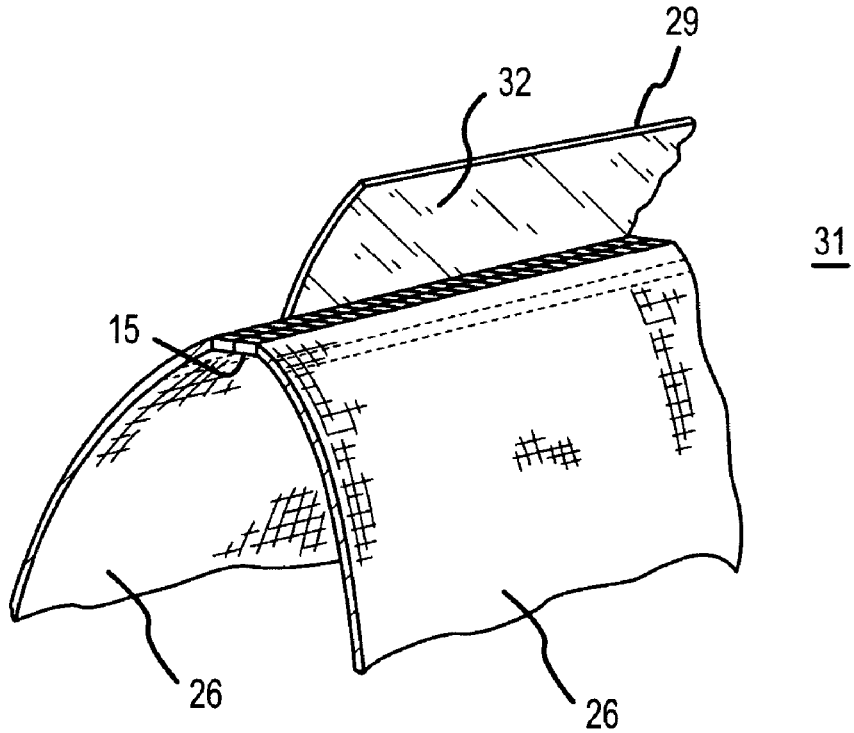

FIG. 22 is a perspective view of the portion of the closure cover shown in FIG. 21 in the warning position.

IV. DETAILED DESCRIPTION OF THE PREFERRED EMBODIMENTS

A material container which provides a flexible layer established in a substantially planar configuration on a support surface for loading material which operably conforms by closure to provide an enclosed space to contain the loaded material.

Figure 1:
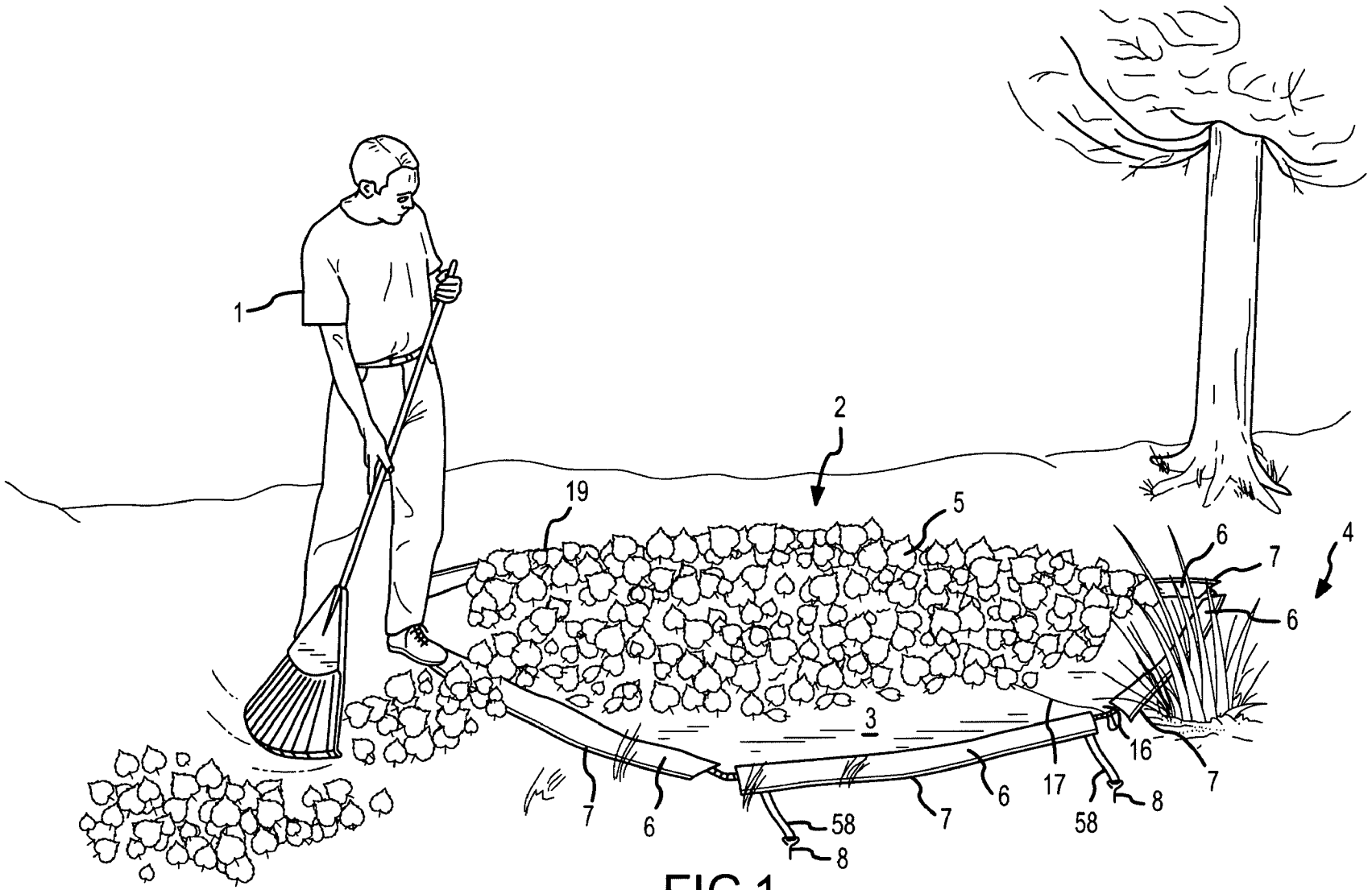
FIG. 1 shows a method of utilizing the substantially planar configuration of a particular embodiment of the material container invention in the open condition to amass or accumulate material thereon.
Figure 2:
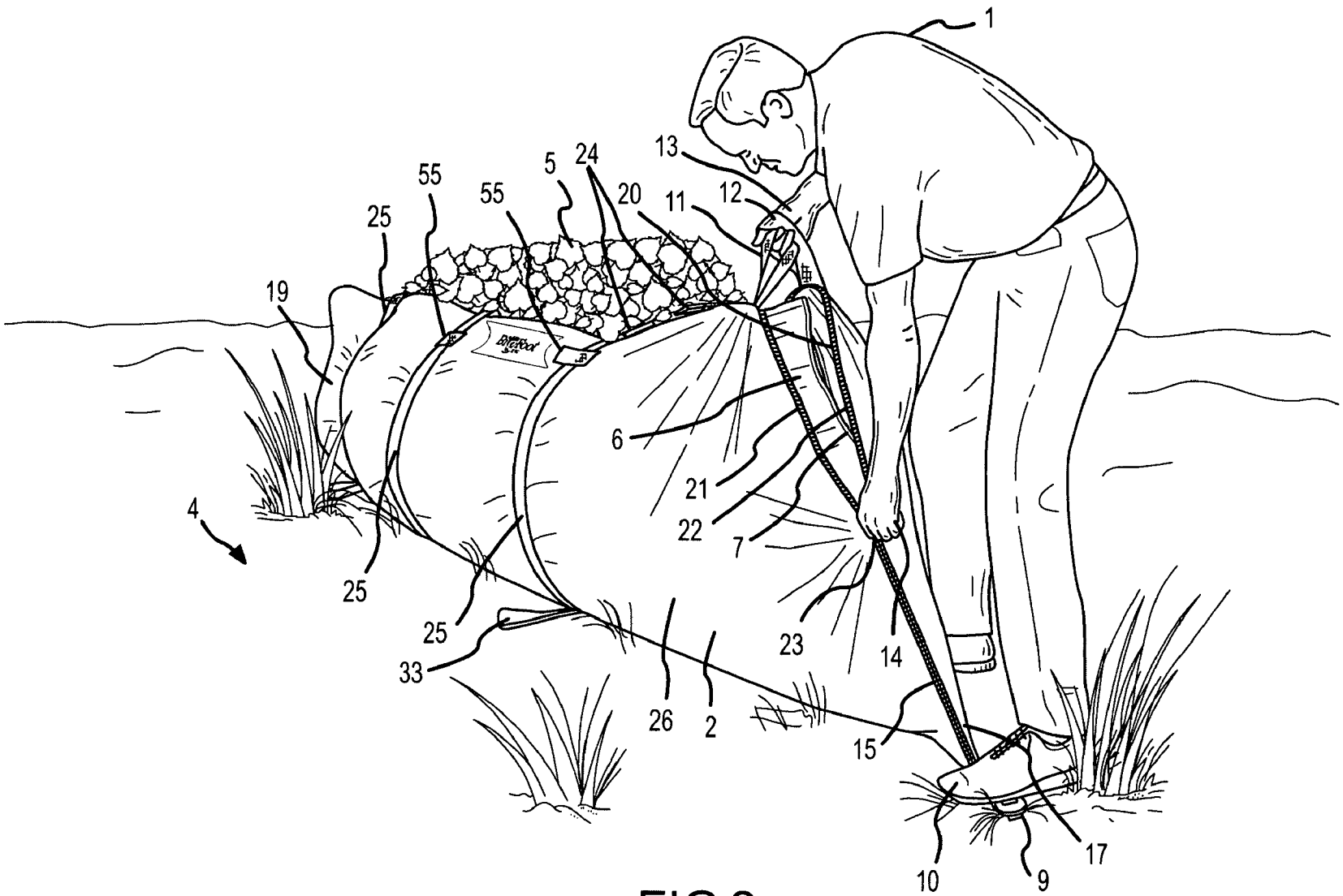
FIG. 2 shows a method of operating a closure element of posture coordinated planar configuration to generate an enclosed space within a particular embodiment of the material container invention.
Figure 3:
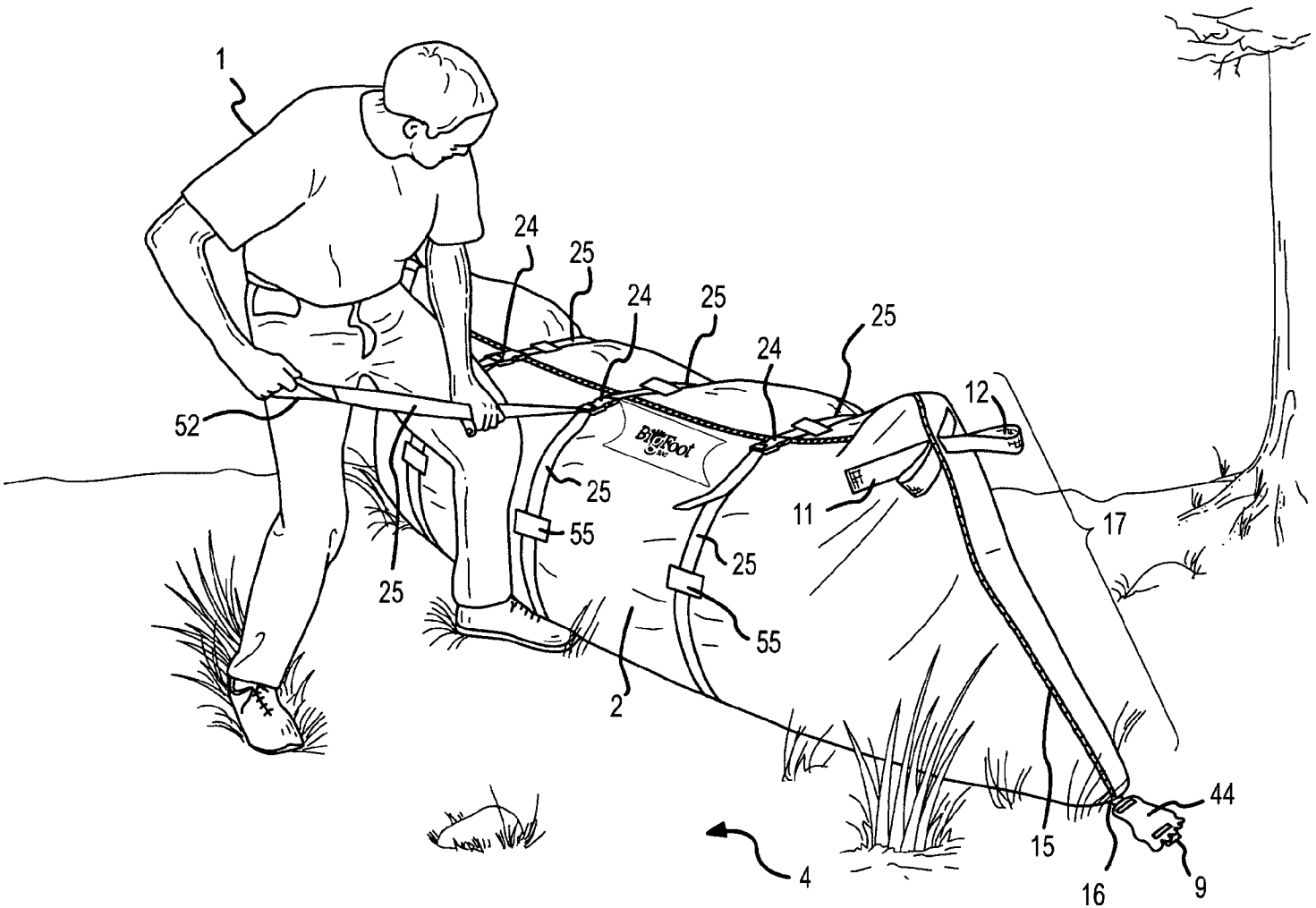
FIG. 3 shows a method of operating a constraint element engaged to the outside surface of a particular embodiment of the material container invention.

Now referring primarily to FIGS. 1 through 3, a method of using an embodiment of the material containment invention is shown. A person (1) can establish the material container (2) in a substantially planar configuration (3) on a support surface (4). A flap or a plurality of flaps (6) can be turned outward to secure the planar configuration (3) at a location on the support surface (4) by action of a securement element (7) such as an amount of weight (36) contained in the flap (6) or in one or more of the plurality of flaps (6) the amount of weight (36) can comprise an amount of particulate (37) contained within the flap (6). Separately, or in combination with an amount of weight (36) in the flap (6), the securement element (7) can comprise a stake or a plurality of stakes (8) tethered (58) to the flexible layer (26) or to the flap (6) and which can be forcibly urged into the support surface (4).

Figure 4:
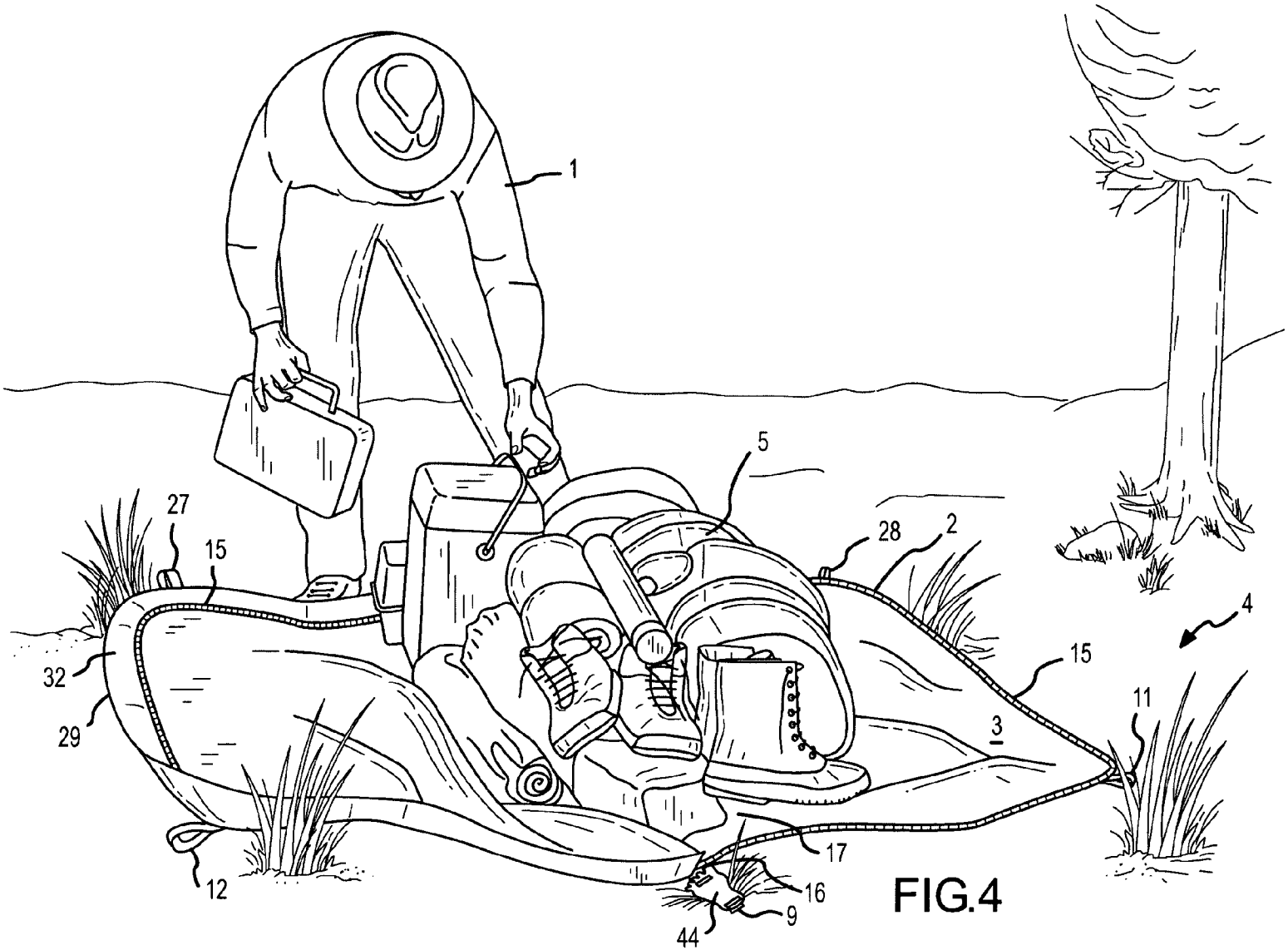
FIG. 4 shows a method of utilizing the substantially planar configuration of an alternate embodiment of the material container invention in the open condition to amass or accumulate material thereon.

Material (5) can then be loaded onto the substantially planar configuration (3) of the material container (2) invention. While FIG. 1 shows the person (1) raking leaves onto the substantially planar configuration (3) of the material container (2) invention, this is not intended to limit the scope of the types of material (5) which can be loaded onto the planar configuration (3) of the material container (2). Rather, the figure is intend to be illustrative of the numerous and varied materials (5) which the person of ordinary skill can load onto the planar configuration (3) of the material container (2) and can include without limitation any manner of material (5) which can be loaded, amassed, accumulated or positioned onto the planar configuration (3), such as leaves, grass, weeds, trimmings, dirt, debris, or the like, or as shown by FIG. 4, can also include without limitation outdoor gear, sports gear, hunting gear, fishing gear, camping gear, climbing gear, clothing, boots, shoes, shirts, pants, tents, backpacks, coolers, sleeping bags, maps, books, tarpaulins, rope, mechanical hardware, cameras, fishing rods, hardware, tools, or the like.

Now referring primarily to FIG. 2, after the material (5) has been loaded onto the planar configuration (3) of the material container (2) the person (1) can turn the flap or plurality of flaps (6) inward along with the securement element (7) whether an amount of weight or stakes (8), or both. The person (1) can then step upon a restraint element (9) with a first foot (10) while gripping a first grip element (11) and a second grip element (12) with a first hand (13). The person can use a second hand (14) to grip a closure element (15) and commencing at an first apex (16) of a first triangular end portion (17) operate the closure element (15) terminating at a second apex (18) of a second triangular end portion (19) to generate an amount of enclosed space (20) in which the material (5) can be contained. Understandably, operation of the closure element (15) could commence at the second apex (18) of the second triangular end portion (19) and terminate at the first apex (16) of the first triangular end portion (17) by utilizing a corresponding second restraint element (34), third grip element (27), and fourth grip element (28), as shown for example by FIG. 6.

The closure element (15) as shown in FIG. 2 comprises a zip or zipper which can consist of a first strip of fabric (21) and a second strip of fabric (22), one each fixed to corresponding portions of the periphery of the planar configuration (3) of the material container (2) which can be engaged to generate the closed condition of the material container (2). Each of the first strip of fabric (21) and the second strip of fabric (22) carries a plurality of teeth. The slider (23), which can be operated by the second hand (14), rides up and down the two sets of teeth to push the opposing sets of teeth together or apart, depending on the slider's direction of travel. However, it is not intended that the invention be limited to the use of a zip or zipper as the closure element (15). Rather, the zipper shown is intended to be illustrative of the numerous and varied closure elements (15) that can be utilized to generate the closed condition of the material container (2), including without limitation, any continuous self interlocking two part fastener with or with a slider or equivalent thereof, or mated hook and loop such as Velcro®, or the like.

Now referring primarily to FIG. 3, with the material container (2) in the closed condition, as shown, the parts of a constraint fastener (24) can be engaged to secure a constraint element (25) about the material container (2). The embodiment of the invention shown by FIG. 3, allows the person (1) to engage the parts of the constraint fastener (24) and then variably adjust the length of the constraint element (25) to the desired configuration about the material container (2).

Figure 5:
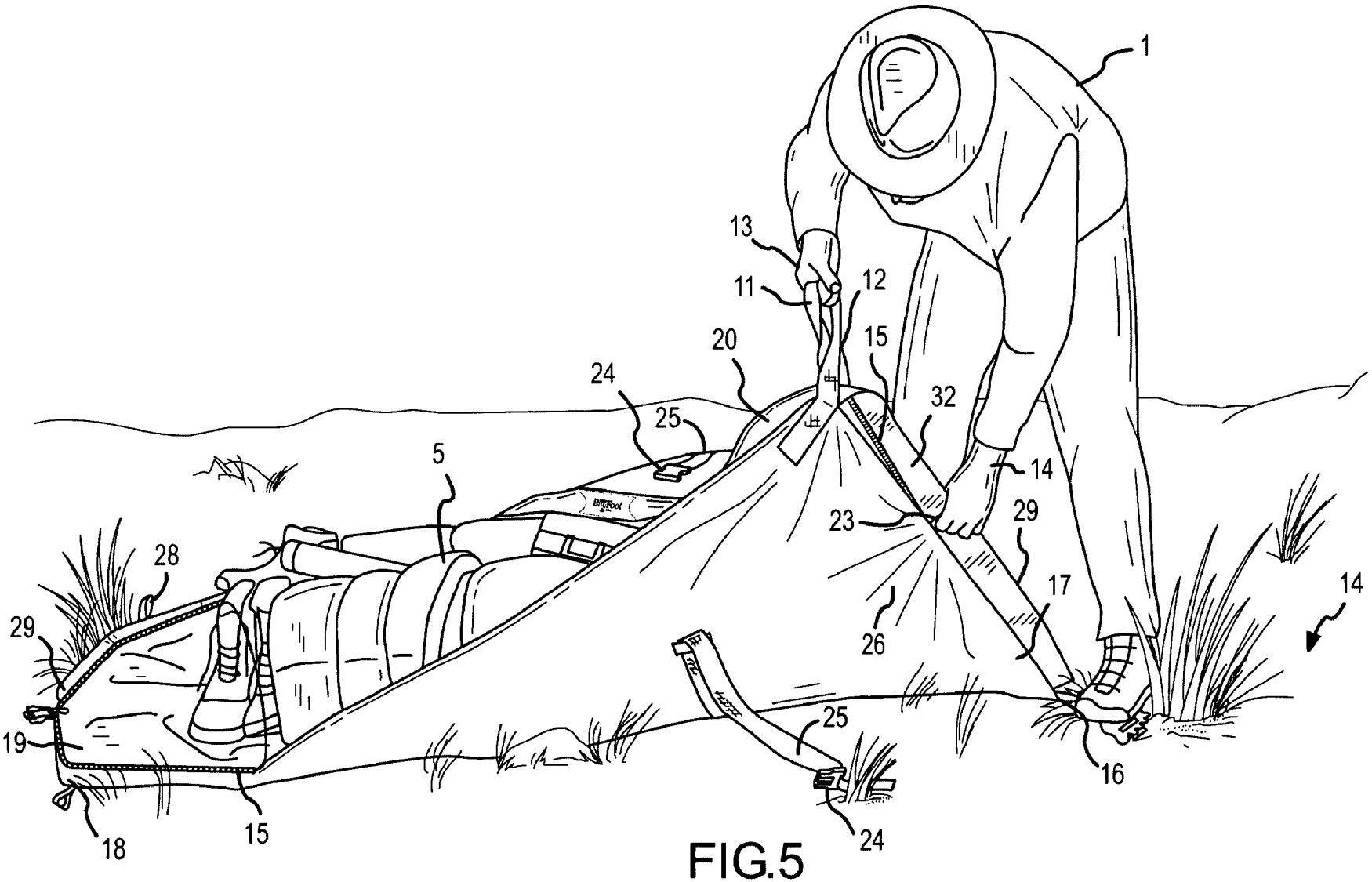
FIG. 5 shows a method of operating a closure element of posture coordinated planar configuration to generate an enclosed space within the alternate embodiment of the material container invention.
Figure 11:
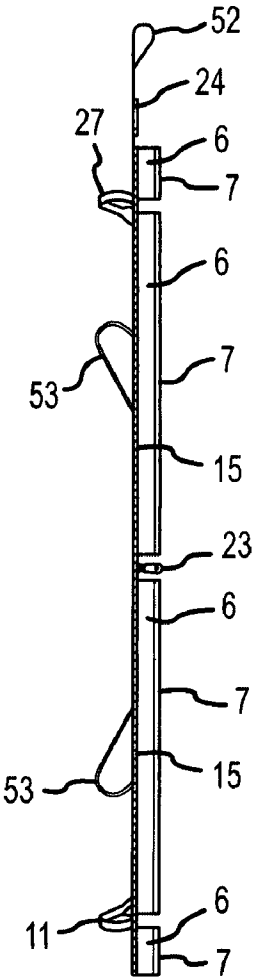
FIG. 11 is a side view of the particular embodiment of the material container invention shown in FIGS. 7-9.

Now referring primarily to FIGS. 4 and 5, an alternate method of using an embodiment of the material containment invention is shown. In addition to the steps above described, it may be desirable in addition to generating the closed condition of the material container (2) to further reduce the egress of materials (5) from within the enclosed space (20) or the ingress of substances from without the enclosed space (20). As such, the material container (2) can be generated from a flexible layer (26) or a first flexible layer (56) adjacent to a second flexible layer (57)(or a plurality of layers as shown by FIG. 11) and further described below, to resist penetration or to decrease permeability of the material container (2) to the material (5) contained in the enclosed space (20) or to substances from without the enclosed space (20) which may include without limitation liquids, water, rain, mixtures of liquids, liquid chemicals, mixtures of liquid chemicals, chemicals whether liquid or solid solubilized in liquids, body fluids, sweat, urine, blood, saliva, solids, particles, dust, sand, dirt, debris, excrement, animal tissue, plant tissue, food, garbage, or the like, separately or in various permutations or combinations.

The person can take the further steps of operating a closure cover (29) coupled to the flexible layer (26) between the first apex (16) of the first triangular region (17) and the second apex (18) of the second triangular region (19) in a manner which allows the closure cover (29) to operably locate over the closure element (15)(as shown by FIGS. 21 and 22) to limit ingress of substances through the closure element (15) into the enclosed space (20). The closure cover (29) can be alternately positioned by the person (1) or by manipulation of the flexible layer (26) to lay over the closure element (15) in a closure cover position (30) to transfer liquids and solids away from the closure element (15), or the closure cover (29) can be positioned by a person (1) or by manipulation of the flexible layer (26) to extend away from the closure element (15) in the warning position (31) which does not cover the closure element (15). In the warning position (31) the observable surface of the closure cover (29) can further include warning indicia (32) to indicate that the closure element (15) is not covered to limit transfer of substances to the enclosed space (20) of the material container (2).

Figure 6:
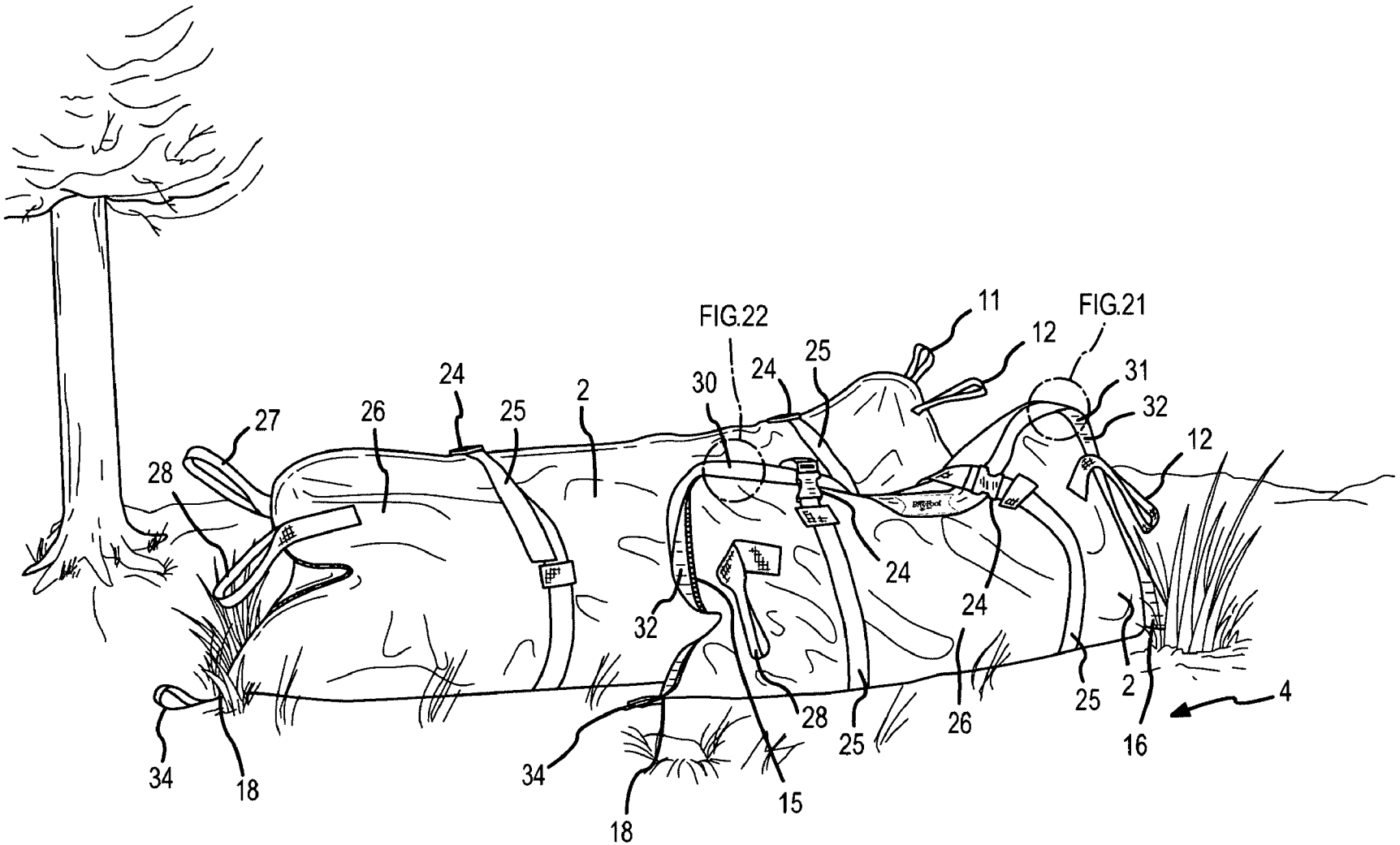
FIG. 6 is a front end perspective view of each of two embodiments of the material container invention in the closed condition.

As shown by FIG. 6, the above described steps can result in generation of a material container (2) in the closed condition which provides an enclosed space (20) which contains material (5). The material container (2) in the closed condition can remain located on the support surface (4) or otherwise be transported with the material (5) contained within the enclosed space (20). The above described steps can, in part or in whole, be performed in reverse order to re-establish the material container (2) in the open condition to provide the planar configuration (3) of the material container (2).

Figure 8:
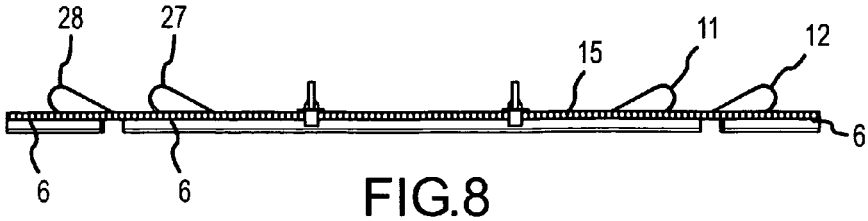
FIG. 8 is a side view of a particular embodiment of the material container invention in the open condition.
Figure 7:
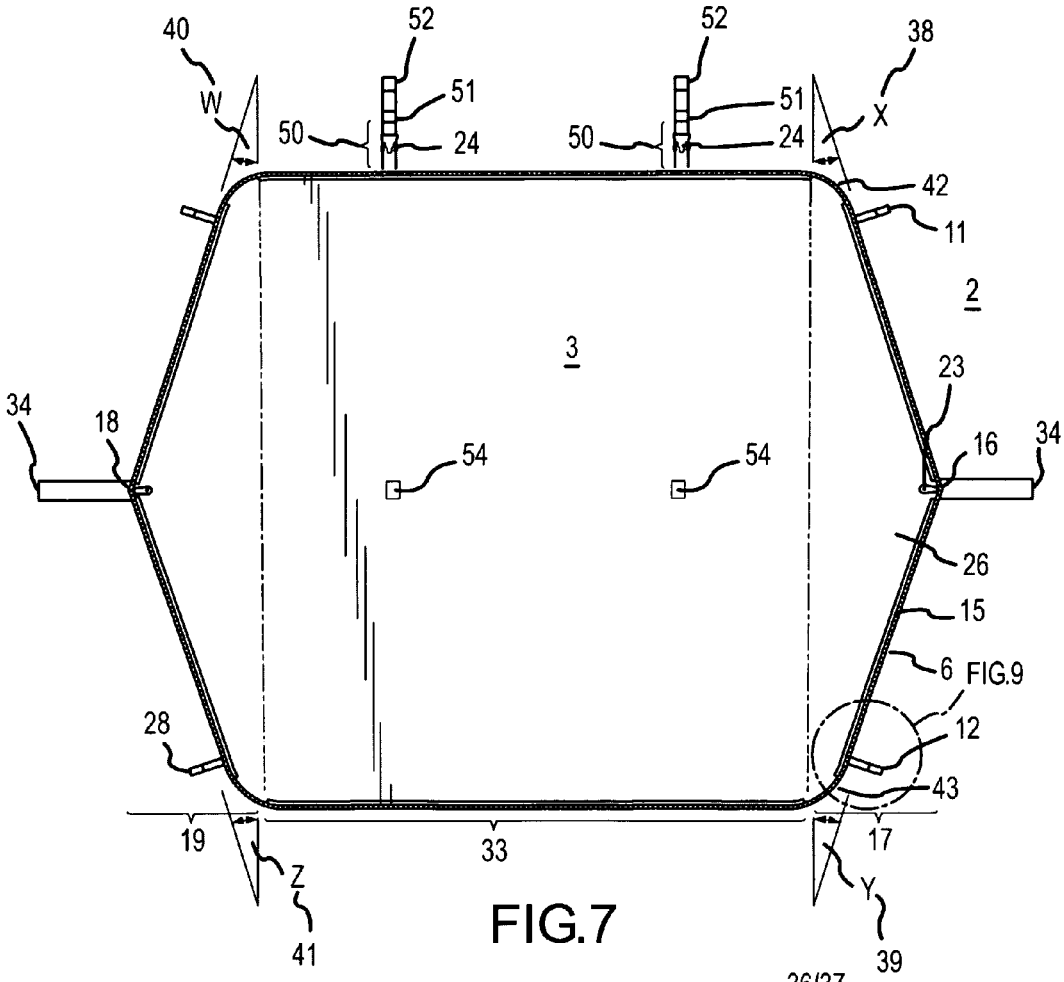
FIG. 7 is a front inside view of a particular embodiment of the material container invention in the open condition.

Now referring primarily to FIGS. 7 and 8 which show a particular embodiment of the material container (2) which provides a flexible layer (26) that can be established in a substantially planar configuration (3). The flexible layer (26) can comprise a single flexible layer or the flexible layer can comprise a first flexible layer (56) located, bonded, or secured adjacent to a second flexible layer (57)(or more flexible layers). The flexible layer (26) or plurality of flexible layers (56)(57) can be generated without limitation from a vinyl, a polyethylene, a polypropylene, a nylon, a polyester, a ultraviolet treated polyester, a polyethylene having a vinyl coat, a polypropylene having a vinyl coat, a nylon having a vinyl coat, a polyester having a vinyl coat, a ultraviolet treated polyester having a vinyl coat, a canvass, or the like. The flexible layer (26) need only be sufficiently flexible to be established in the substantially planar configuration (3) to provide the open condition of the material container (2) as shown by FIG. 7 and conformable by operation of the closure element (15) to generate the enclosed space (20) in the closed condition as shown by FIG. 6. Understandably, the flexible layer (26) or plurality of flexible layers can be further selected to provide a desired level of strength or durability depending upon the type, kind, or the amount of material (5) to be loaded on the material container (2) in the open condition.

Figure 9:
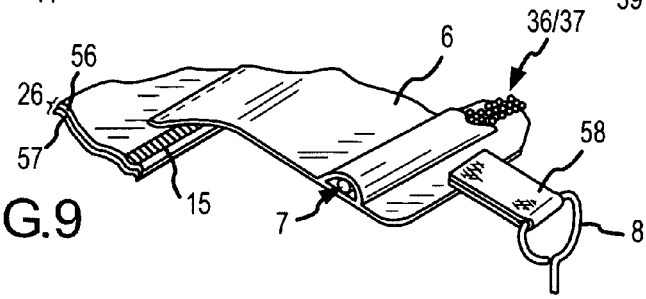
FIG. 9 is blow up of an embodiment of the flap element and securement element of a particular embodiment of the material container invention.

Also it is to be understood that the term "substantially planar configuration" and the particular embodiments of the "substantially planar configuration" shown by the figures are not intended to limit the material container (2) invention solely to those embodiments of an open condition of the material container (2) in which the flexible layer (26) is established in a single plane, but rather broadly encompasses a wide variety of alternate configurations of the flexible layer (26) which would ordinarily occur when a flexible layer is laid open for loading as described, and specifically includes without limitation, those configurations of the flexible layer (26) generated in the open condition due to: the topography of the underlying support surface (4), variation in the flexible layer material, variation in production steps such as unequal tensioning of the flexible layer due to joining, stitching, bonding, or the like, subsequent use of the flexible layer which may stretch or otherwise deform the flexible layer (26), or similar variations, and further includes depending upon the embodiment of the invention, the closure element (15), the flaps (6) which operate between a position extended outward to traverse over the closure element (15) (as shown for example by FIG. 9) or positioned inward to lie upon the inside surface of the flexible layer (26), and the closure cover (29) (as shown by FIG. 19) which operates between a first closure cover position (30) and a warning position (32)(as shown by FIGS. 21 and 22).

Now again referring primarily to FIG. 7, the flexible layer (26) can be established in the substantially planar configuration to provide a substantially square or substantially rectangular center body portion (33)(hash marked lines added for convenience) having a pair of opposed sides each correspondingly coupled to the first triangular end portion (17) and the second triangular end portion (19) respectively in an open condition of said material container (2)(or as shown in the closed condition by FIG. 3).

The parts of the closure element (15) can be coupled to substantially the entirety of the periphery of the substantially planar configuration (3) to commence operation proximate to the first apex (16) of said first triangular end portion (17) and to terminate operation proximate to the second apex (18) of said second triangular end portion (19), thereby generating an amount of enclosed space (20) in the closed condition of the material container (2).

The first triangular end portion (17) can establish a first angle "x" (38) between a base (shown in hash marked line) of the first triangular end portion (17) and a first leg of the first triangular end portion (17) and can establish a second angle "y" (39) between the base (shown in hash marked line) of said first triangular end portion (17) and a second leg of the first triangular end portion (17). Typically the first angle "x" (38) and the second angle "y" (39) are of similar or of substantially the same angle which can vary depending upon the embodiment of the material container (2) invention between about ten degrees and about forty five degrees.

Similarly, the second triangular end portion (19) can establish a first angle "w" (40) between a base (shown in hash mark line) of said second triangular end portion (19) and a first leg of said second triangular end portion (19) and a second angle "z" (41) can be established between the base (shown in hash mark line) of the second triangular end portion (19) and a second leg of the second triangular end portion (19). Again, typically, the first angle "w" (40) and the second angle "z" (41) are of similar or of substantially the same angle which can vary depending upon the embodiment of the material container (2) invention between about ten degrees and about forty five degrees.

The amount of angle established by the first angle "x" (38) and the second angle "z" (39) of the first triangular end portion (17) and the first angle "w" (40) and the second angle "z" (41) of the second triangular end portion (19) can each independently or in combination alter force characteristics with respect to operation of the closure element (15) to generate the closed condition of the material container (2). Altered force characteristics can comprise a reduction in the amount of force to operate the closure element (15) between the first apex (16) of the first triangular end portion (17) and the second apex (18) of the second triangular end portion (19) whether in whole, or as to a particular portion of the operation; or altered force characteristics can comprise an alteration in the vector forces as received by the material container (2) or as applied by the person (1) operating the closure element (15), or both.

Altering the vector forces as received by the material container (2) or as applied by the person (1), can significantly reduce efforts by the person (2) to commence operation of the closure element (15), to terminate operation of the closure element (15), or to establish the material container (2) in the closed condition, even in those instances where there is no reduction in the overall amount of force utilized to generate the closed condition of the material container (2).

In addition, with reference to FIGS. 2 and 5, the first angle "x" (38) and the second angle "z" (39) of the first triangular end portion (17) and the first angle "w" (40) and the second angle "z" (41) of the second triangular end portion (19) when established in the range between about ten degrees and about forty five degree locates the first apex (16) of the first triangular end region (17) on the support surface (4) proximate to the foot (10) of the person (2) while a first vertex (42) of the flexible layer (26) generated by establishing the first angle "x" (38) and a second vertex (43) of the flexible layer (26) generated by establishing the second angle "y" (39) can both be located proximate to the first hand (13) of the person (1) while the second hand (14) of the person (1) operates the closure element (15). The relative positions established between the person (2) and the material container (2) configured as above-described allows the closed condition of the material container (2) to be achieved with less effort on the part of the person (1).

Moreover, configuring the planer configuration (3) to include the first triangular end portion (17) and the second triangular end portion (19) provides a portion of the flexible layer (26), otherwise lacking, which disseminates force imposed by the material (5) contained within the enclosed space (20) over a greater surface area proximate to the ends of the material container (2) in the closed configuration.

Although the examples of the material container (2) shown by the drawings each show a first triangular end portion (17) and a second triangular end portion (19) certain embodiments of the material container (2) invention may include only the first triangular region (17) or only the second triangular region (19), or with no triangular end portion (but otherwise benefiting from other inventive elements described herein), the closure element (15) configured accordingly.

Now referring primarily to FIGS. 7, 12 and 13, a first restraint element (9) can be coupled to the flexible layer (26) proximate to the first apex (16) of the first triangular end portion (17) and a second restraint element (34) can be coupled proximate to the second apex (18) of the second triangular end portion (19). As to those embodiments which do not afford the first triangular end portion (17) or the second triangular end portion (19), the restraint elements (9)( ) can be coupled at a location proximate to the perimeter of the flexible layer (26) at which the closure element (15) commences operation or terminates operation. The restraint elements (9)( ) each provide a pair of opposed surfaces which correspondingly engage a foot (10) of the person (1) and the support surface (4) to substantially fix the corresponding apex (16)(18) of the first triangular end portion (17) or the second triangular end portion (19) at a location on said support surface (4) during operation of the closure element (15) with the first hand (14) of the person (1).

As shown by FIGS. 12 and 13, the restraint element (9)(34) can be a strip of material coupled at each strip end to the perimeter of the flexible layer (26) to form a loop which can be flattened to engage the opposed inside surfaces. Alternately the restraint element (9)(34) can be a single thickness of material coupled at one end to the perimeter of the flexible layer (26) or other configuration of material which can be engaged between the foot (10) of the person (1) and the support surface (4) to substantially fix the location of the flexible layer (26) or the corresponding apex (16)(18) of the first triangular end portion (17) of the flexible layer (26) or the second triangular end portion (19) of the flexible layer (26) to oppose operational forces of the closure element (15).

As to the embodiment of the restraint element shown by FIGS. 7, 12 and 13, the restraint element (9) can be generated from one or more restraint material(s) such as those above-described for the flexible layer (26) or other restraint material depending upon the application which can be configured to provide engagable surface areas as described which as to certain embodiments of the invention can have a width of about three-quarters inch to about one and one-half inch and a length of about three inches to about six inches.

Now referring primarily to FIGS. 12 and 13, the material container (2) invention can further provide a force dissemination element (44) responsive to the restraint element (9) which increases the surface area engaged between the foot (14) of the person (1) and the support surface (4). The force dissemination element (44) can be coupled to the restraint element (9) by passing a portion of the restraint element (9) through a restraint fastener element (45), such as the pair of closed end U shaped fasteners shown by FIG. 13, prior to coupling the ends of the restraint element (9) to the perimeter of the flexible layer (26). Alternately, as shown by FIG. 12, the force dissemination element (44) can be removably coupled to the restraint element (9) by passing a portion of the restraint element (9) through restraint fastener element (45) such as the slots (46) which communicate between the opposed surfaces of the force dissemination element (44) as shown by FIG. 12.

The force dissemination element (44) can have numerous and varied configurations which act to increase the area engaged between the foot (14) of the person (1) and the support surface (4), such as a square, rectangle, triangle, circle, or other non-geometric configuration to aid in fixing the location of the flexible layer (26) as the closure element (15) operates, and the configuration of the force dissemination element (44) as shown by FIGS. 12 and 13 as a stylized foot (47) is not intended to be limiting with respect to the configurations of the force dissemination element (44) encompassed by the invention. As to the embodiment of the force dissemination element (44) shown by FIGS. 12 and 13, the stylized foot (47) can serve as a visual indicator to the person (1) as to how the force dissemination element (44) can be used during operation of the closure element (15).

Figure 10:
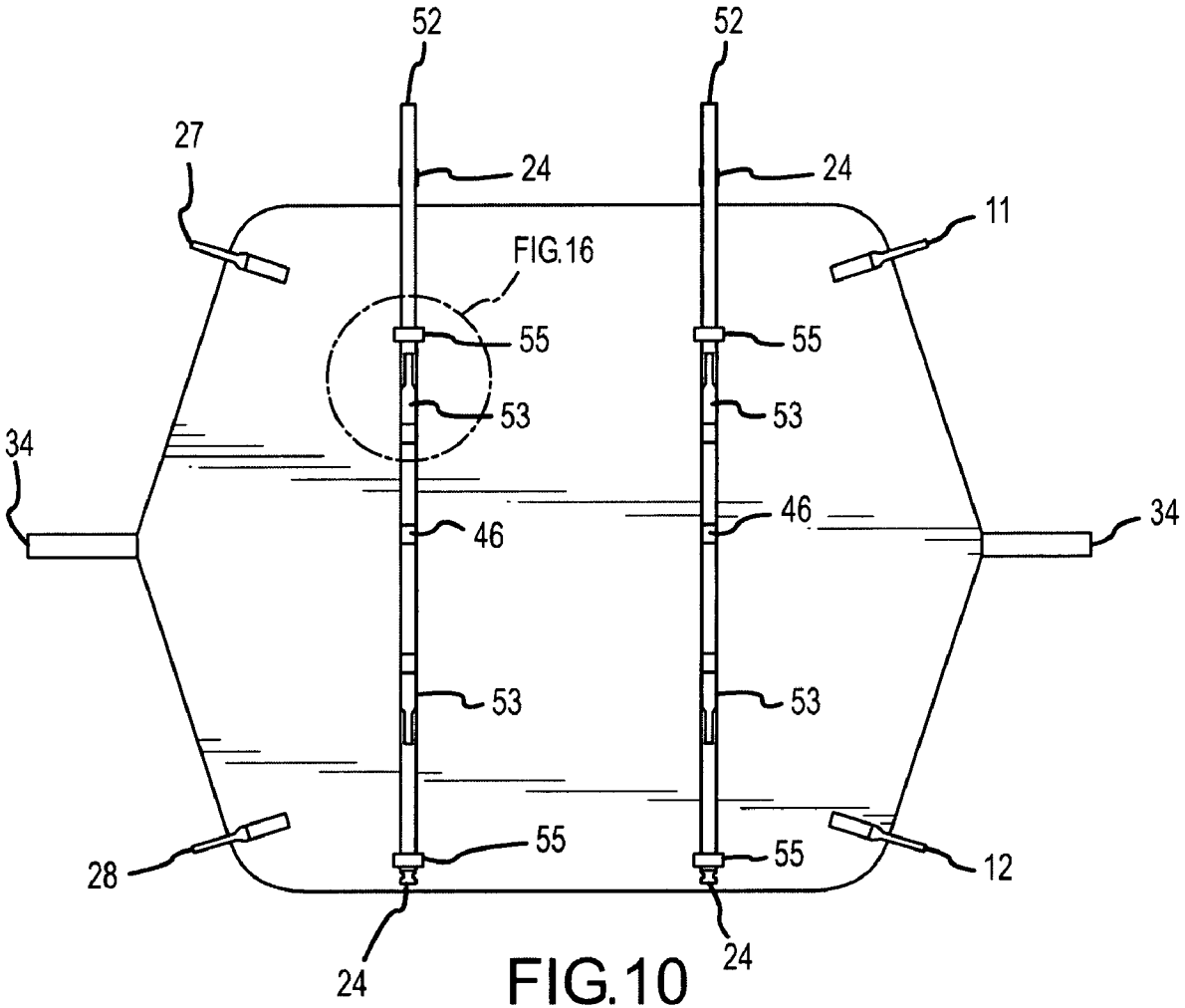
FIG. 10 is a front outside view of the particular embodiment of the material container invention shown in FIGS. 7-9.

Now referring primarily to FIGS. 10 and 11, the material container (2) invention can further provide the parts of a constraint fastener (24) which can be engaged to secure a constraint element (25) about the material container (2)(examples shown in detail by FIGS. 15 through 18) in the closed condition. The embodiment of the constraint element(s) (25) shown by FIGS. 10 and 11 each provide an adjustable strap a portion of which couples to the flexible layer (26) by stitching, adhering, bonding, or the like (the "coupled portion (46) of the constraint element (25)") which can variably constrict about the material container (2). The coupled portion (46) of the constraint element (25) can be limited to an area of sufficient size (as shown for example by FIG. 10) to avoid detachment of the constraint element (25) from the flexible layer (26) during ordinary use of the material container (2) while allowing the remaining portion of the constraint element (25) to slidely engage the outside surface of the flexible layer (26) as shown by FIG. 17. Reinforcement layers (54) can be utilized to increase strength of coupled portion (46) of the constraint element (25).

As shown by FIGS. 14 and 15, at least one of the matable parts of the constraint fastener (24) can be coupled to the constraint element (25) in a manner which allows adjustment of the length of the constraint element (25). In the embodiment of the invention shown by the Figures, the constraint fastener (24) can include a first fastener part (48) coupled to a first end (49) of the constraint element (25) in a manner which does not allow adjustment of the first fastener part (48) along the length of the constraint element (25). A second fastener part (50) slidely engages the constraint element (25) in a manner which allows the second fastener part (50) to fixedly engage the constraint element at any location between the second end (51) of the constraint element (25) and the first end (49), or the coupled portion (46) of the constraint element, depending upon the embodiment of the invention. The second end (51) of the constraint element (25) can further provide a constraint grip (52) which can be utilized by the person (1) as described above and as shown by FIG. 3 to tension the constraint element (25) about the material container (2). Additional constraint grips (53) can be coupled along the length of the constraint element (25) with the location and number depending upon the embodiment of the invention. While FIG. 10 shows an embodiment of the invention which provides two constraint elements (25), depending upon the configuration of the material container (2) in the closed condition, additional constraint elements (25) can be provided (see for example the embodiment of the invention shown by FIG. 3 having three constraint elements (25) although neither embodiment the invention is intended to be limiting with regard to the placement or number of constraint elements (25) utilized by a particular embodiment of the invention).

As shown by FIGS. 10 and 16, for example, alignment elements (55) can be coupled to the outside surface of the flexible layer (26) to slidely engage the constraint element (25) to locate engagement of the constraint element (25) with the outside surface of the flexible layer (26) of the material container (2).

Now referring primarily to FIGS. 19 and 20, an alternate embodiment of the material container (2) invention can further comprise a closure cover (29) coupled to a portion of the perimeter of the flexible layer (26) in a manner which allows the closure cover (29) to operate between the closure cover position (30) in which the closure cover (29) lies over the closure element (15) to deflect, shed, or otherwise reduce the amount of substances as above-described which contact or can transfer through the closure element (15) to the enclosed space (20) of the material container (2)(as shown by FIG. 21) and the warning position (32) which makes sensorially perceivable warning indicia (32) observable to the person (1)(as shown by FIG. 22). The sensorially perceivable warning indicia (32) can include without limitation a warning color such as orange, red, or yellow or other color sufficiently different from the color of the outside surface of the flexible layer (26), a reflective surface or reflective material, warning symbols or characters or words such as a "circle with diagonal line" or "OPEN", or the like, separately or in various permutations an combinations, whether integral or applied to the surfaces observable to the person (1) in the warning position (31).

As shown by FIG. 19, the closure cover (29) can be coupled to the portion of the perimeter of the flexible layer (26) along the outside of closure element (15). As to the particular embodiment of the material container (2) invention shown, the closure cover (29) can be coupled along the outside of the closure element (15) between the first apex (16) of the first triangular end portion (17) and the second apex (18) of the second triangular end portion (35). The closure cover (29) can be similarly coupled the flexible layer (26) of those embodiments of the invention which provide only the rectangular body portion (33) without the first triangular end portion (34) or the second triangular end portion (35), or both.

As can be easily understood from the foregoing, the basic concepts of the present invention may be embodied in a variety of ways. The invention involves numerous and varied embodiments of a material containment system and methods of making and using such material containment system.

As such, the particular embodiments or elements of the invention disclosed by the description or shown in the figures accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "restraint" should be understood to encompass disclosure of the act of "restraining"—whether explicitly discussed or not—and, conversely, were there effectively disclosure of the act of "restraining", such a disclosure should be understood to encompass disclosure of a "restraint" and even a "means for restraining." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the material containment devices herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A material container, comprising:

a. a flexible layer established in a substantially planar configuration to provide a rectangular center body portion having a pair of opposed sides each correspondingly coupled to a first triangular end portion and a second triangular end portion in an open condition of said material container;

b. a closure element coupled to substantially the entirety of a perimeter edge of said substantially planar configuration which commences operation proximate to an apex of said first triangular end portion of said flexible layer established in said substantially planar configuration and terminates operation proximate to an apex of said second triangular end portion of said flexible layer to generate an amount of enclosed space in a closed condition of said material container; and c. a restraint element connected to said perimeter edge of said substantially planar configuration of said flexible layer proximate said apex of said first triangular end portion, said restraint element having a configuration which extends a distance outwardly from said perimeter edge of said substantially planar configuration and having a first surface configured to engage a support surface at a location outside of said perimeter edge of said substantially planar configuration and a second surface configured to engage a foot of a person, said restraint element capable of securement to said support surface at said location outside of said perimeter of said substantially planar configuration by said foot engaged to said second surface of said restraint element.

2. A material container as described in claim 1, wherein said closure element comprises a self interlocking two part fastener having a first part coupled to a first perimeter portion of said flexible layer and a second part coupled to a second perimeter portion of said flexible layer.

3. A material container as described in claim 2, wherein said closure element comprises a zipper.

4. A material container as described in claim 2, wherein said first triangular end portion has a first angle "x" established between a base of said first triangular end portion and a first leg of said first triangular end portion and a second angle "y" established between said base of said first triangular end portion and a second leg of said first triangular end portion act to alter an amount of force applied to operate said closure, and wherein said first angle "x" and said second angle "y" are substantially the same angle.

5. A material container as described in claim 4, wherein said first angle "x" and said second angle "y" are each between about fifteen degrees and about forty five degrees.

6. A material container as described in claim 5, wherein said second triangular end portion has a first angle "w" established between a base of said second triangular end portion and a first leg of said second triangular end portion and a second angle "z" established between said base of said second triangular end portion and a second leg of said second triangular end portion, and wherein said first angle "w" and said second angle "z" are substantially the same angle, and wherein said first angle "w" and said second angle "z" are each between about fifteen degrees and about forty five degrees.

7. A material container as described in claim 6, further comprising a force dissemination element coupled to said restraint element, said force dissemination element having a pair of opposed surfaces, wherein a first of said opposed surfaces has a configuration adapted to engage said support surface at a location outside of said perimeter edge of said substantially planar configuration, and wherein a second of said opposed surfaces has a configuration adapted to engage said foot of said person to secure said restraint element in relation to said support surface at said location outside of said perimeter edge of said substantially planar configuration, thereby forces generated by engagement of said foot of said person with said second of said opposed surfaces spreads over a increased area of said second of said opposed surfaces engaged with said support surface.

8. A material container as described in claim 7, further comprising a first grip element coupled at a location on the outside surface of said substantially planar configuration at a location proximate to the vertex of said first angle "x".

9. A material container as described in claim 8, further comprising a second grip element coupled at a location on the outside surface of said substantially planar configuration at a location proximate to the vertex of said second angle "y".

10. A material container as described in claim 9, wherein each of said first grip element and said second grip have a location on an outside surface of said substantially planar configuration grippable in second hand of a person as said first hand of said person operates said closure element and said foot of said person engages said restraint element to secure said restraint element in relation to said support surface at said location outside of said perimeter edge of said substantially planar configuration.

11. A material container as described in claim 10, wherein said force dissemination element has a configuration of a stylized foot.

12. A material container as described in claim 10, further comprising a flap coupled to said flexible layer which locates upon operation of said closure element between an amount of material positioned on said planar configuration of said material container in said open condition and said closure element.

13. A material container as described in claim 12, wherein said flap comprises a plurality of flaps coupled to said flexible layer each of which locate upon operation of said closure element between an amount of material positioned on said planar configuration of said material container in said open condition and a portion of said closure element.

14. A material container as described in claim 13, further comprising a securement element coupled to said flap which acts upon said support surface to resist movement of said planar configuration upon said support surface.

15. A material container as described in claim 14, wherein said securement element comprises an amount of weight coupled to said flap element.

16. A material container as described in claim 15, wherein said amount of weight comprises an amount of particulate contained within said flap element.

17. A material container as described in claim 16, wherein said amount of weight comprises at least one rod element coupled to said flap element.

18. A material container as described in claim 15, wherein said securement element comprises at least one stake coupled to said flap element.

19. A material container as described in claim 18, wherein said flap element comprises said plurality of flap elements and wherein said at least one stake element couples to at least one of said plurality of flap elements.

20. A material container as described in claim 14, further comprising a closure cover coupled to said flexible layer which operates between a warning position and a closure cover position.

21. A material container as described in claim 20, further comprising a warning indicia coupled to a surface of said closure cover observable in said warning position.

22. A material container as described in claim 1, wherein said flexible layer is selected from the group consisting of a vinyl, a polyethylene, a polypropylene, a nylon, a polyester, a ultraviolet treated polyester, a polyethylene having a vinyl coat, a polypropylene having a vinyl coat, a nylon having a vinyl coat, a polyester having a vinyl coat, a ultraviolet treated polyester having a vinyl coat, and a canvass.

* * * * *